United States Patent [19]

Forschirm

[11] Patent Number: 4,788,948

[45] Date of Patent: Dec. 6, 1988

[54] METHOD OF WARMING COLD ENGINES IN COLD CLIMATES

[75] Inventor: Alex Forschirm, Parsippany, N.J.

[73] Assignee: Hoechst Celanese Corporation, Chatham, N.J.

[21] Appl. No.: 116,993

[22] Filed: Nov. 5, 1987

[51] Int. Cl.[4] ..... F02N 17/02

[52] U.S. Cl. ..... 123/142.5 R; 44/541; 126/207

[58] Field of Search ..... 123/142.5 R; 44/541; 126/207, 19.5

[56] References Cited

FOREIGN PATENT DOCUMENTS 85480 5/1984 Japan ..... 123/142.5 R

*Primary Examiner*—E. Rollins Cross

*Attorney, Agent, or Firm*—Herbert Price Lynch, Cox, Gilman

[57] ABSTRACT

The instant invention involves a method for warming cold or frozen engines in low temperature conditions, such as minus 40° F. or below. The method involves draping a fabric bag containing a flammable compound, such as trioxane, over an engine and igniting the flammable compound.

6 Claims, No Drawings

METHOD OF WARMING COLD ENGINES IN COLD CLIMATES

BACKGROUND OF INVENTION

The field of art to which this invention pertains is cold engines and a method of warming them.

It is well known that cold weather makes engines harder to start. For engines that contain oil, cold temperatures increase the oil viscosity and thereby make it harder for the starter of the engine to spin the engine. Cold temperatures also affect engines that employ batteries, such as automobile engines. Cold temperatures slow the chemical reactions in the battery, thereby decreasing the battery output. In extremely low temperatures, such as those below minus 20° F. and those found in arctic or antarctic climates, engines can freeze.

There are a variety of methods that have been utilized to start or heat engines in cold conditions. With respect to automobile engines, special aerosols, such as those containing ether or heptane, are sprayed into a carburetor.

In addition, battery warmers, oil heaters, and coolant heaters have been employed for automobile engines and other engines. Oil heaters heat the oil so as to reduce its viscosity. Coolant heaters heat the engine's coolant which circulates throughout the engine block thereby heating up the engine. Such devices, however, usually require several hours of operation before an engine can be started.

A cruder method of heating a cold engine is to pour hot water over various parts of the engine. For example, water can be poured over the fuel pump, fuel line, fuel filter and carburetor bowl of an automobile engine. However, the use of hot water can have the adverse effect of getting into the carburetor or dampening spark plugs of the automobile engine. Sometimes automobile engines have been heated or kept warm by building a fire and then parking the automobile over the coals.

In extremely cold climates, such as in arctic regions, it is a common practice to heat frozen engines with open flames or dangerous fuels such as gasoline. The explosive nature of gasoline makes such practices dangerous, and open flames can be extinguished by some of the winds which are common in arctic regions. Thus, there is a need for a means to quickly. easily and safely warm or unfreeze engines in cold climates.

It is an object of this invention to warm cold engines.

It is another object to provide a means for safely and quickly warming cold engines.

It is a further object of this invention to heat frozen engines in arctic conditions so they can be started.

SUMMARY OF THE INVENTION

This invention relates to a method for quickly warming engines in cold climates. In one aspect, this invention pertains to a method for heating or warming frozen engines in arctic conditions. In another aspect, this invention realtes to a method for unfreezing engines using a flammable substance. The method of this invention comprises the steps of placing a flammable substance, such as trioxane, in a fabric bag of a non-flammable material, draping the bag over a frozen engine, and igniting the flammable material to unfreeze the engine.

DESCRIPTION OF THE INVENTION

Virtually any crystalline or powder substance which is flammable and can be readily contained in a fabric bag can be utilized in the present invention. The preferred flammable substances are trioxane, hexamethylenetetramine (HMTA), and paraformaldehyde. Trioxane is the most preferred substance. Since cyanide is a by-product when HMTA is burned, HMTA should only be employed in open areas.

The preparation of trioxane, HMTA and paraformaldehyde is well known in the art. Trioxane is a highly flammable crystalline compound derived from formaldehyde and is flammable both in its crystalline and molten state. It burns with a non-luminous flame, gives off no smoke, dangerous chemicals or soot, ignites with one match at temperatures as low as minus 40° F., and its flame is resistant to wind extinguishment. As a result, trioxane is quite suitable for use in arctic conditions where there are winds and low temperatures. HMTA is derived from ammonia and formaldehyde and is flammable in its crystalline state. Paraformaldehyde is a solid and a mixture of polyoxymethylene glycols.

The solid flammable substance is placed into a fabric bag prepared from a nonflammable material. Any nonflammable material which is capable of being formed or woven into a fabric bag and which will not burn or be consumed when the flammable substances of the present invention are ignited can be utilized. Examples of such nonflammable materials are aramid or aromatic polyamide fibers, such as Nomex R, and Kevlar R fibers, which are both commercially available from E. I. Du Pont De Nemours, polybenzimidazole, fiberglass, and Kynol R fibers, which are fibers prepared from crosslinked amorphous phenolic polymers and which are commercially available from the Harbison-Carborundum Corporation. The preferred fibers are prepared from polybenzimidazole, glass or aromatic polyamides, with polybenzimidazole fibers being the most preferred nonflammable fibers. The preparation of the fibers useful in this invention is well known in the art. For example, the preparation of suitable polybenzimidazole fibers is disclosed in U.S. Pat. Nos. 4,263,245, 3,541,199 and 3,441,640, which are incorporated herein by reference.

The fibers are woven into a fabric bag utilizing any of the weaving techniques well known in the art. The weave of the bag must be such that a sufficient amount of oxygen can enter the bag to permit the flammable substance to burn. Preferably, the bag can be closed at both ends so that once the flammable solid is placed inside the bag, it will not fall onto the ground.

It should be obvious to one skilled in the art that the size of the bag can be custom designed to fit a particular engine and that the bag can be draped over only those parts of the engine that need to be heated instead of over the entire engine block. For example, if only the coolant or oil needs to be heated, a bag can be placed over the engine area containing the coolant or oil.

The flammable material is placed inside the nonflammable fabric bag and is generally evenly distributed in the bag. The amount of flammable substance placed inside the bag will, of course, vary depending upon the flammable substance used, the size of the engine, the temperature, and other weather conditons. Generally, larger engines will require a greater amount of the flammable substance than smaller ones, and lower ambient temperatures will require a greater amount of the flammable substance than higher temperatures. A sufficient amount of flammable material is placed in the bag so that when ignited, the flammable substance will burn for an amount of time sufficient to warm or unfreeze the engine and raise it to a temperature where the engine can start.

After the flammable material is consumed, the engine can be started. If the engine is not warm enough after a first attempt using the filled bag of the present invention, additional attempts can be made until the engine is warm enough for it to be started.

The method of this invention finds particular utility when used to warm or unfreeze engines in very cold temperatures, such as in arctic conditions. The advantage of using such bags to heat and unfreeze engines over some of the current practices in arctic conditions is obvious. The method does not employ highly flammable and explosive liquids, such as gasoline, which are currently poured on some engines and then ignited. Thus, it is safer than such methods. In addition, the method warms an engine much more quickly than methods employing traditional oil and coolant heaters. Furthermore, due to the placement of the flammable solid in a fabric bag, there is more control over where the flammable substance is placed, and there is less likelihood of the flammable substance getting onto parts of the engine that should not be exposed to flames or of falling onto the ground and thereby creating a fire hazard. Moreover, since flammable substances that are powders or are crystalline are employed, the flammable substances can be readily transported to remote areas or carried around in the back of vehicles. Thus, one could easily carry the non-flammable bag and several pounds of a flammable substance around in one's vehicle in the artic and have them readily available to use when needed.

In addition, since the flammable substances are powders or are crystalline, they can be more easily and safely transported than flammable liquids, such as gasoline. Also, the use of powders and crystalline materials makes it easy to place the flammable material into the bag and to insure that the bag remains flexible so that it can be draped over any part of an engine.

The invention is described in more detail in the following examples.

Example 1

About two pounds of crystalline trioxane are placed and evenly distributed in a polybenzimidazole fabric bag having a tight weave and measuring about one by two feet. The bag is then placed on top of a frozen automobile engine. The ambient temperature is about minus 40° F. The trioxane is ignited by placing a match on the polybenzimidazole bag. After the trioxane is consumed, the engine is sufficiently warm for the automobile to be started.

Example 2

Example 1 is repeated except that HMTA is used instead of trioxane and a bag prepared from glass fibers is used instead of the polybenzimidazole bag. After the HMTA is consumed, the engine is warmed sufficiently so that the car can start.

What is claimed:

1. A method of warming cold engines in low temperature conditions comprising the steps of: (a) placing a flammable compound inside a nonflammable fabric bag; (b) placing the bag on an engine; and (c) igniting the flammable compound.

2. The method of claim 1 wherein the flammable compounds is hexamethylenetetramine.

3. The method of claim 1 wherein the flammable compound is trioxane.

4. The method of claim 1 wherein the flammable compound is paraformaldehyde.

5. The method of claim 1 wherien the nonflammable bag is prepared from polybenzimidazole, aromatic polyamide, or glass fibers.

6. The method of claim 1 wherein the nonflammable bag is prepared from polybenzimidazole fibers.

* * * * *